US008531107B2

(12) United States Patent
Sutardja

(10) Patent No.: US 8,531,107 B2
(45) **Date of Patent: *Sep. 10, 2013**

(54) CONTROL SYSTEM FOR FLUORESCENT LIGHT FIXTURE

(75) Inventor: Sehat Sutardja, Los Altos Hills, CA (US)

(73) Assignee: Marvell World Trade Ltd, St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 13/400,269

(22) Filed: Feb. 20, 2012

(65) Prior Publication Data

US 2012/0146551 A1 Jun. 14, 2012

Related U.S. Application Data

(63) Continuation of application No. 12/502,570, filed on Jul. 14, 2009, now Pat. No. 8,120,286, which is a continuation of application No. 11/112,808, filed on Apr. 22, 2005, now Pat. No. 7,560,866.

(60) Provisional application No. 60/672,250, filed on Apr. 18, 2005.

(51) Int. Cl.
*H01J 7/44* (2006.01)
*H05B 37/02* (2006.01)

(52) U.S. Cl.
USPC ..... 315/50; 315/309

(58) Field of Classification Search
USPC ..... 315/291, 307, 308, 309, 224, 200 R, 315/209 R, 32, 50, 112
See application file for complete search history.

(56) References Cited

U.S. PATENT DOCUMENTS

| | | | | |
|---|---|---|---|---|
| 3,587,061 | A | 6/1971 | Bieszczad et al. | |
| 3,978,368 | A | 8/1976 | Tomura et al. | |
| 5,063,490 | A * | 11/1991 | Maehara et al. | 363/37 |
| 5,309,066 | A | 5/1994 | Ditlevsen | |
| 5,357,170 | A * | 10/1994 | Luchaco et al. | 315/159 |
| 5,402,303 | A | 3/1995 | Luck et al. | |
| 5,744,912 | A | 4/1998 | So | |

(Continued)

FOREIGN PATENT DOCUMENTS

| | | |
|---|---|---|
| EP | 1 338 874 A1 | 8/2003 |
| JP | H04-126349 | 4/1992 |

(Continued)

OTHER PUBLICATIONS

Translation of Notice of Reasons for Rejection issued in JP Pat. App. No. P2006-099049 dated Jun. 14, 2011.

(Continued)

*Primary Examiner* — Minh D A

(57) ABSTRACT

A circuit includes a component connected (i) to a rectifier, and (ii) between electrodes of a lamp. The electrodes include a first electrode and a second electrode. A control module is in communication with the rectifier and is configured to receive a temperature signal from a temperature sensor. The temperature signal is indicative of a temperature of the component. The control module is also configured to decrease current to the electrodes for a predetermined period when the temperature of the component is greater than a first predetermined temperature. The control module is further configured to increase the current to the electrodes when the predetermined period expires and independent of the temperature of the component.

20 Claims, 5 Drawing Sheets

(56) References Cited

U.S. PATENT DOCUMENTS

| | | | | |
|---|---|---|---|---|
| 5,798,614 | A | 8/1998 | Bishop et al. | |
| 5,973,455 | A | 10/1999 | Mirskly et al. | |
| 5,977,723 | A | 11/1999 | Yoon | |
| 6,066,920 | A | 5/2000 | Torihara et al. | |
| 6,081,077 | A | 6/2000 | Canova et al. | |
| 6,140,751 | A | 10/2000 | Hammer et al. | |
| 6,140,772 | A | 10/2000 | Bishop et al. | |
| 6,191,539 | B1 | 2/2001 | Green | |
| 6,222,325 | B1 | 4/2001 | Wuidart et al. | |
| 6,285,138 | B1 * | 9/2001 | Kataoka et al. | 315/291 |
| 6,300,728 | B1 | 10/2001 | Blackburn et al. | |
| 6,304,646 | B1 * | 10/2001 | Liot et al. | 379/201.04 |
| 6,339,299 | B1 | 1/2002 | Wu et al. | |
| 6,366,031 | B2 | 4/2002 | Klien | |
| 6,424,100 | B1 | 7/2002 | Kominami et al. | |
| 6,453,145 | B1 * | 9/2002 | Miura | 399/336 |
| 6,525,479 | B1 | 2/2003 | Keggenhoff et al. | |
| 6,710,993 | B1 * | 3/2004 | Wang | 361/93.1 |
| 6,713,966 | B2 | 3/2004 | Shultz et al. | |
| 6,728,088 | B2 | 4/2004 | Aiello et al. | |
| 6,731,078 | B2 | 5/2004 | Huber et al. | |
| 6,781,328 | B2 | 8/2004 | Horiuchi et al. | |
| 6,828,740 | B2 | 12/2004 | Takahashi et al. | |
| 6,880,967 | B2 | 4/2005 | Isozumi et al. | |
| 6,909,246 | B2 | 6/2005 | Hein | |
| 6,940,733 | B2 | 9/2005 | Schie et al. | |
| 7,126,288 | B2 | 10/2006 | Ribarich et al. | |
| 7,145,342 | B2 | 12/2006 | Wendt et al. | |
| 7,414,369 | B2 | 8/2008 | Sutardja | |
| 7,560,866 | B2 * | 7/2009 | Sutardja | 315/46 |
| 2002/0101185 | A1 | 8/2002 | Kozlowski | |
| 2003/0156988 | A1 | 8/2003 | Sondergaard | |
| 2004/0178748 | A1 * | 9/2004 | Hamaguchi et al. | 315/291 |
| 2004/0183472 | A1 * | 9/2004 | Kamoi et al. | 315/291 |

FOREIGN PATENT DOCUMENTS

| | | |
|---|---|---|
| JP | 2000-082589 | 3/2000 |
| JP | 2000-231997 | 8/2000 |
| JP | 2003-243269 | 8/2003 |
| JP | 2004-342321 | 12/2004 |
| WO | WO 88/01467 A1 | 2/1988 |
| WO | WO 2005/006820 A1 | 1/2005 |

OTHER PUBLICATIONS

Official Action including the Search Report and Written Opinion from the Intellectual Property Office of Singapore dated May 23, 2007 for Singapore Application No. 200601868-3; 15 pages.

Official Action including the Search Report and Written Opinion from the Intellectual Property Office of Singapore dated May 23, 2007 for Singapore Application No. 200601867-5; 15 pages.

Examination Report from the European Patent Office dated May 21, 2007 for Application No. 06 006 307.0-2206; 1 page.

Communication from the European Patent Office dated Oct. 6, 2006 and the extended European Search Report for Application No. 06 006 308.8-2206; 6 pages.

Communication from the European Patent Office dated Sep. 12, 2006 and the extended European Search Report for Application No. 06 006 307.0-2206; 6 pages.

* cited by examiner

CONTROL SYSTEM FOR FLUORESCENT LIGHT FIXTURE

CROSS-REFERENCE TO RELATED APPLICATIONS

This application is a continuation of U.S. patent application Ser. No. 12/502,570 (now U.S. Pat. No. 8,120,286), filed Jul. 14, 2009. U.S. patent application Ser. No. 12/502,570 is a continuation of U.S. patent application Ser. No. 11/112,808 (now U.S. Pat. No. 7,560,866), filed Apr. 22, 2005, which claims the benefit of U.S. Provisional Application No. 60/672,250, filed Apr. 18, 2005. The disclosures of the above applications are incorporated herein by reference.

FIELD

The present invention relates to fluorescent light fixtures, and more particularly to control systems for fluorescent light fixtures.

BACKGROUND

Referring now to FIG. 1, a fluorescent lamp 10 includes a sealed glass tube 12 that contains a first material such as mercury and a first inert gas such as argon, which are both generally identified at 14. The tube 12 is pressurized. Phosphor powder 16 may be coated along an inner surface of the tube 12. The tube 12 includes electrodes 18A and 18B (collectively electrodes 18) that are located at opposite ends of the tube 12. Power is supplied to the electrodes 18 by a control system that may include an AC source 22, a switch 24, a ballast module 26 and a capacitor 28.

When the switch 24 is closed, the control system supplies power to the electrodes 18. Electrons migrate through the gas 14 from one end of the tube 12 to the opposite end. Energy from the flowing electrons changes some of the mercury from a liquid to a gas. As electrons and charged atoms move through the tube 12, some will collide with the gaseous mercury atoms. The collisions excite the atoms and cause electrons to move to a higher state. As the electrons return to a lower energy level they release photons or light. Electrons in mercury atoms release light photons in the ultraviolet wavelength range. The phosphor coating 16 absorbs the ultraviolet photons, which causes electrons in the phosphor coating 16 to jump to a higher level. When the electrons return to a lower energy level, they release photons having a wavelength corresponding to white light.

To send current through the tube 12, the fluorescent light 10 needs free electrons and ions and a difference in charge between the electrodes 18. Generally, there are few ions and free electrons in the gas 14 because atoms typically maintain a neutral charge. When the fluorescent light 10 is turned on, it needs to introduce new free electrons and ions.

The ballast module 26 outputs current through both electrodes 18 during starting. The current flow creates a charge difference between the two electrodes 18. When the fluorescent light 10 is turned on, both electrode filaments heat up very quickly. Electrons are emitted, which ionizes the gas 14 in the tube 12. Once the gas is ionized, the voltage difference between the electrodes 18 establishes an electrical arc. The flowing charged particles excite the mercury atoms, which triggers the illumination process. As more electrons and ions flow through a particular area, they bump into more atoms, which frees up electrons and creates more charged particles. Resistance decreases and current increases. The ballast module 26 regulates power both during and after startup.

Referring now to FIG. 2, some ballast modules 50 include a control module 54, one or more electrolytic capacitors 56 and other components 58. The electrolytic capacitors 56 may be used to filter or smooth voltage. Electrolytic capacitors 56 and/or other system components may be sensitive to high operating temperatures. If the operating temperature exceeds a threshold for a sufficient period, the electrolytic capacitor 56 and/or other system components may be damaged and the fluorescent light 10 may become inoperable.

SUMMARY

A circuit includes a component connected (i) to a rectifier, and (ii) between electrodes of a lamp. The electrodes include a first electrode and a second electrode. A control module is in communication with the rectifier and is configured to receive a temperature signal from a temperature sensor. The temperature signal is indicative of a temperature of the component. The control module is also configured to decrease current to the electrodes for a predetermined period when the temperature of the component is greater than a first predetermined temperature. The control module is further configured to increase the current to the electrodes when the predetermined period expires and independent of the temperature of the component.

In other features, a method is provided and includes operating a control module based on an output of a rectifier. A temperature signal is received from a temperature sensor by the control module. The temperature signal is indicative of a temperature of a component. The component is connected (i) to the rectifier, and (ii) between electrodes of a lamp. The electrodes include a first electrode and a second electrode. Current to the electrodes is decreased for a predetermined period via the control module when the temperature of the component is greater than a first predetermined temperature. The current to the electrodes is increased via the control module when the predetermined period expires independent of the temperature of the component.

In other features, a ballast module for a fluorescent light is provided and includes an electrolytic capacitance element. A temperature sensor senses a temperature of the electrolytic capacitance element. A control module communicates the temperature sensor and adjusts power output to the fluorescent light when the sensed temperature exceeds a predetermined threshold.

In other features, the control module reduces the power output to the fluorescent light. The control module reduces the power output for a predetermined period. The control module increases power output to the fluorescent light after the predetermined period. The control module turns off the power output to the fluorescent light. The control module turns off the power output for a predetermined period. The control module increases power output to the fluorescent light after the predetermined period. The control module modulates the power output based on the sensed temperature.

In other features, a system is provided and includes the ballast module and a switch that selectively provides power to the control module. The switch is a three-way switch. A rectifier module has an input that selectively communicates with a voltage source. The electrolytic capacitance element and the control module communicate with an output of the rectifier module.

In other features, the ballast module further includes a first power transistor having a first terminal that communicates with a first output terminal of the rectifier and a control terminal that communicates with the control module. A second power transistor has a first terminal that communicates with a second terminal of the first power transistor, and a control terminal that communicates with the control module. A second capacitance element communicates with the first and second terminals of the first power transistor. An inductance element has one end that communicates with the second terminal of the first power transistor and an opposite end that communicates with an electrode of the fluorescent light.

In other features, a system is provided and includes the ballast module and the fluorescent light having first and second pairs of electrodes. A third capacitance element communicates with one of the first pair of electrodes and one of the second pair of electrodes. In other features, a system is provided and includes the ballast module and the fluorescent light having first and second pairs of electrodes. A fourth capacitance element communicates with one of the first pair of electrodes and the second capacitance element.

In other features, a ballast module for a fluorescent light is provided and includes an electrolytic capacitance means for providing capacitance. Temperature sensing means senses a temperature of the electrolytic capacitance means. Control means communicates with the temperature sensing means for adjusting power output to the fluorescent light when the sensed temperature exceeds a predetermined threshold.

In other features, the control means reduces the power output to the fluorescent light. The control means reduces the power output for a predetermined period. The control means increases power output to the fluorescent light after the predetermined period. The control means turns off the power output to the fluorescent light. The control means turns off the power output for a predetermined period. The control means increases power output to the fluorescent light after the predetermined period. The control means modulates the power output based on the sensed temperature.

In other features, a system is provided and includes the ballast module and switching means for selectively providing power to the control means. The switching means is a three-way switching means. Rectifier means for rectifying has an input that selectively communicates with a voltage source. The electrolytic capacitance means and the control means communicate with an output of the rectifier means. First power switching means for switching has a first terminal that communicates with a first output terminal of the rectifier and a control terminal that communicates with the control means. Second power switching means for switching has a first terminal that communicates with a second terminal of the first power switching means, and a control terminal that communicates with the control means. Second capacitance means for providing capacitance communicates with the first and second terminals of the first power switching means. Inductance means for providing inductance has one end that communicates with the second terminal of the first power switching means and an opposite end that communicates with an electrode of the fluorescent light.

In other features, a system is provided and includes the ballast module and the fluorescent light having first and second pairs of electrodes. Third capacitance means for providing capacitance communicates with one of the first pair of electrodes and one of the second pair of electrodes. In other features, a system is provided and includes the ballast module and the fluorescent light having first and second pairs of electrodes. Fourth capacitance means for providing capacitance and that communicates with one of the first pair of electrodes and the second capacitance means.

In other features, a method for operating a ballast module for a fluorescent light is provided and includes providing an electrolytic capacitance element in the ballast module; sensing a temperature of the electrolytic capacitance element; and adjusting power output to the fluorescent light when the sensed temperature exceeds a predetermined threshold.

In other features, the method includes reducing the power output to the fluorescent light. The method includes reducing the power output for a predetermined period. The method includes increasing power output to the fluorescent light after the predetermined period. The method includes turning off the power output to the fluorescent light. The method includes turning off the power output for a predetermined period. The method includes increasing power output to the fluorescent light after the predetermined period. The method includes modulating the power output based on the sensed temperature. The method includes selectively providing power to the control module.

In other features, a control system for a fluorescent light is provided and includes a first electrical component. A temperature sensor senses a temperature of the first electrical component. A control module communicates with the temperature sensor and adjusts power output to the fluorescent light when the sensed temperature exceeds a predetermined threshold.

In other features, the control module reduces the power output to the fluorescent light. The control module reduces the power output for a predetermined period. The control module increases power output to the fluorescent light after the predetermined period. The control module turns off the power output to the fluorescent light. The control module turns off the power output for a predetermined period. The control module increases power output to the fluorescent light after the predetermined period. The control module modulates the power output based on the sensed temperature.

The control system further includes a switch that selectively provides power to the control module. The switch is a three-way switch. A rectifier module has an input that selectively communicates with a voltage source. The electrolytic capacitance element and the control module communicate with an output of the rectifier module.

In other features, the control system further includes a first power transistor having a first terminal that communicates with a first output terminal of the rectifier and a control terminal that communicates with the control module. A second power transistor has a first terminal that communicates with a second terminal of the first power transistor, and a control terminal that communicates with the control module. A second capacitance element communicates with the first and second terminals of the first power transistor. An inductance element has one end that communicates with the second terminal of the first power transistor and an opposite end that communicates with an electrode of the fluorescent light.

The control system further includes the fluorescent light having first and second pairs of electrodes. A third capacitance element communicates with one of the first pair of electrodes and one of the second pair of electrodes. The control system further includes the fluorescent light having first and second pairs of electrodes. A fourth capacitance element communicates with one of the first pair of electrodes and the second capacitance element.

In other features, a control system for a fluorescent light is provided and includes first means for providing a first electrical function. Temperature sensing means senses a temperature of the first means. Control means communicates with the temperature sensing means for adjusting power output to the fluorescent light when the sensed temperature exceeds a predetermined threshold.

In other features, the control means reduces the power output to the fluorescent light. The control means reduces the power output for a predetermined period. The control means increases power output to the fluorescent light after the predetermined period. The control means turns off the power output to the fluorescent light. The control means turns off the power output for a predetermined period. The control means increases power output to the fluorescent light after the predetermined period. The control means modulates the power output based on the sensed temperature.

The control system further includes switching means for selectively providing power to the control means. The switching means is a three-way switching means. Rectifier means for rectifying has an input that selectively communicates with a voltage source. The electrolytic capacitance means and the control means communicate with an output of the rectifier means. First power switching means for switching has a first terminal that communicates with a first output terminal of the rectifier and a control terminal that communicates with the control means. Second power switching means for switching has a first terminal that communicates with a second terminal of the first power switching means, and a control terminal that communicates with the control means. Second capacitance means for providing capacitance communicates with the first and second terminals of the first power switching means. Inductance means for providing inductance has one end that communicates with the second terminal of the first power switching means and an opposite end that communicates with an electrode of the fluorescent light.

The control system further includes the fluorescent light having first and second pairs of electrodes. Third capacitance means for providing capacitance communicates with one of the first pair of electrodes and one of the second pair of electrodes. The control system further includes the fluorescent light having first and second pairs of electrodes. Fourth capacitance means for providing capacitance and that communicates with one of the first pair of electrodes and the second capacitance means.

In other features, a method for operating a control system for a fluorescent light is provided and includes providing a first electrical component; sensing a temperature of the first electrical component; and adjusting power output to the fluorescent light when the sensed temperature exceeds a predetermined threshold.

In other features, the method includes reducing the power output to the fluorescent light. The method includes reducing the power output for a predetermined period. The method includes increasing power output to the fluorescent light after the predetermined period. The method includes turning off the power output to the fluorescent light. The method includes turning off the power output for a predetermined period. The method includes increasing power output to the fluorescent light after the predetermined period. The method includes modulating the power output based on the sensed temperature. The method includes selectively providing power to the control module.

Further areas of applicability of the present invention will become apparent from the detailed description provided hereinafter. It should be understood that the detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
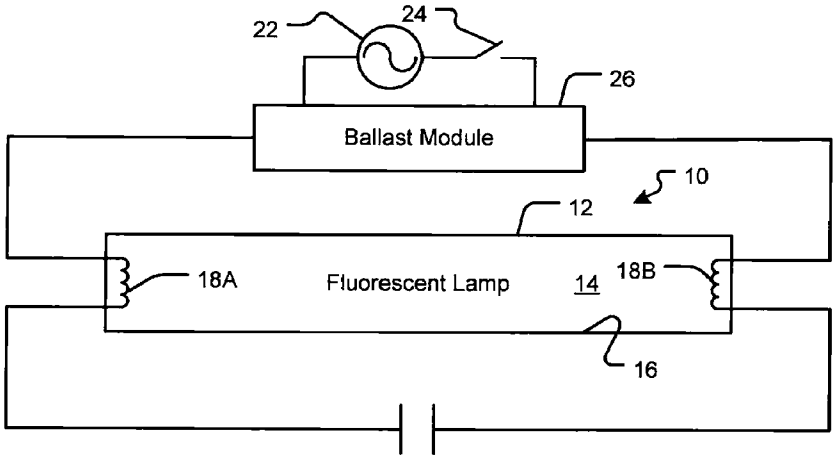
FIG. 1 Prior Art
FIG. 1 is a functional block diagram of an exemplary control system for a fluorescent light according to the prior art.
Figure 2:
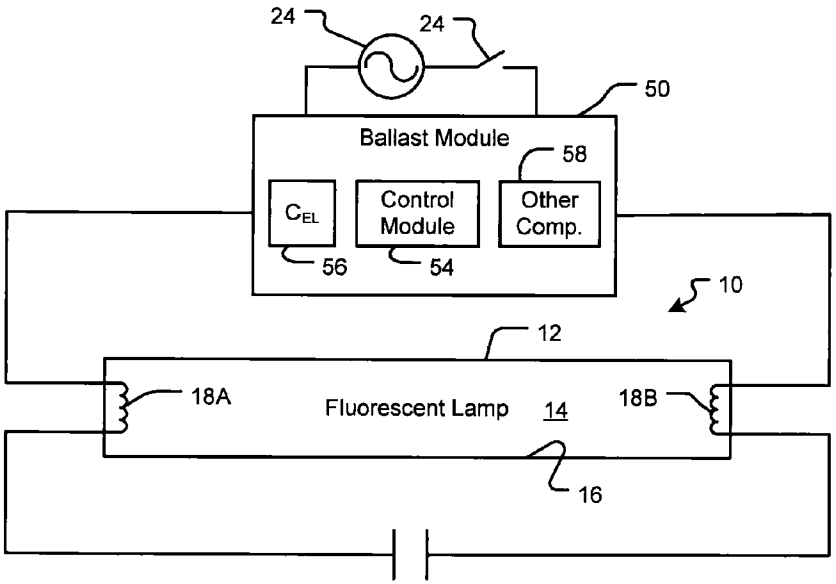
FIG. 2 Prior Art
FIG. 2 is a more detailed functional block diagram of the control system for the fluorescent light of FIG. 1.

The following description is merely exemplary in nature and is in no way intended to limit the invention, its application, or uses. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality. For purposes of clarity, the same reference numbers will be used in the drawings to identify similar elements.

Figure 3:
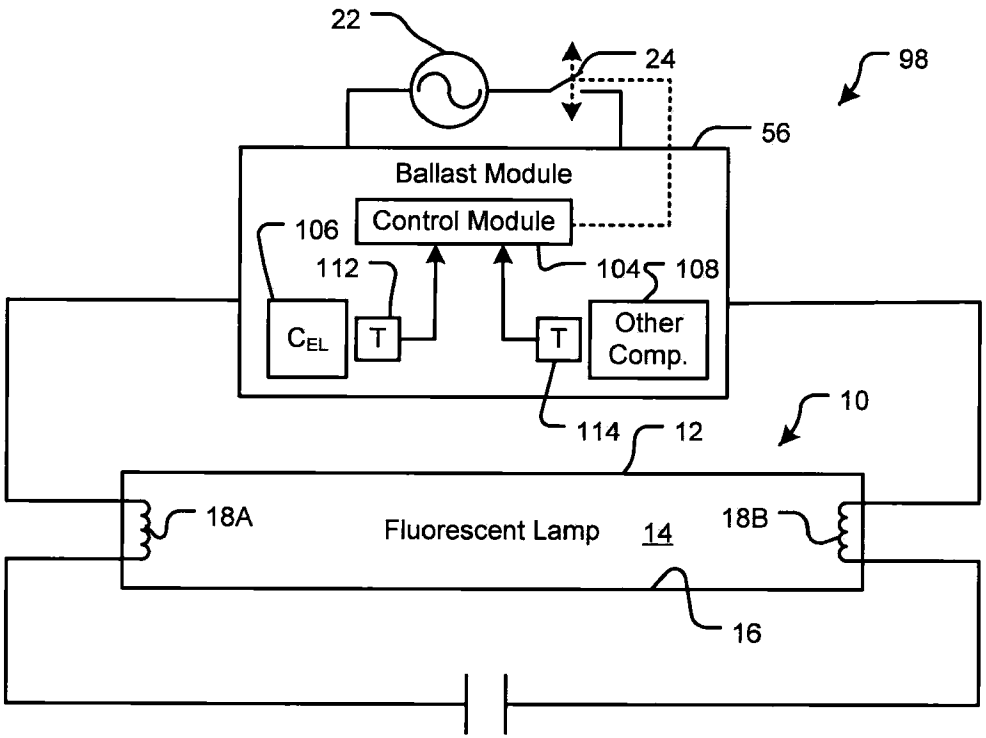
FIG. 3 is a functional block diagram of an improved control system for a fluorescent light according to the present invention.

Referring now to FIG. 3, a functional block diagram of a control system 98 for the fluorescent light 10 is shown. A ballast module 100 includes a control module 104, one or more electrolytic capacitors 108, and one or more other components generally identified at 110. The ballast module 100 includes one or more temperature sensing modules 112 and 114 that sense operating temperatures of components of the ballast module 100 and/or of the control system of the florescent light 10. In some implementations, the temperature sensor 112 senses an operating temperature of the electrolytic capacitor 108 and the temperature sensor 114 senses an operating temperature of one or more other components 110 of the ballast module 100 and/or the control system.

The control module 104 adjusts operation of the fluorescent light 10 based on one or more of the sensed operating temperatures. For example, the control module 104 shuts off the florescent light 10 when the operating temperature of the electrolytic capacitor 56 exceeds a predetermined temperature threshold. Alternately, the control module 104 turns off the florescent light 10 for a predetermined period, until reset, indefinitely and/or using other criteria. In other implementations, the control module 104 lowers an output voltage and/or current of the ballast module 100 for a predetermined period, indefinitely, until reset and/or using other criteria.

Figure 4:
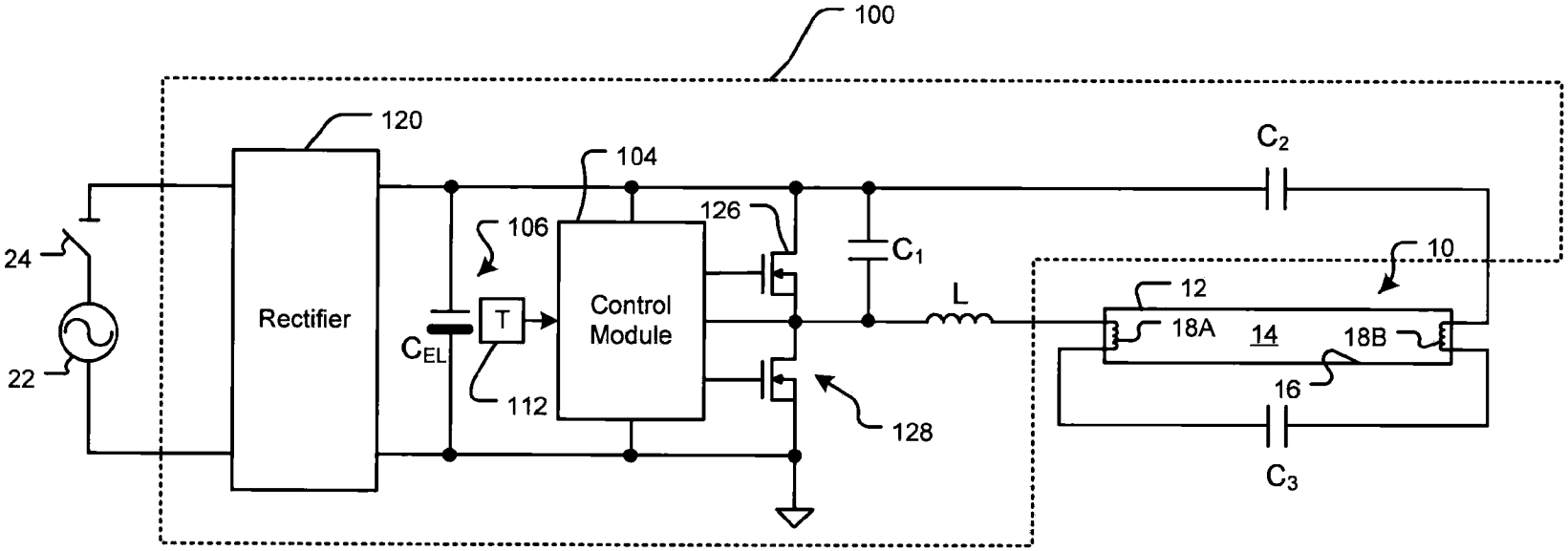
FIG. 4 is an electrical schematic and functional block diagram of an exemplary implementation of the control system of FIG. 3.

Referring now to FIG. 4, an exemplary implementation of the ballast module 100 is shown to include a full or half-wave rectifier 120, the electrolytic capacitor 106 and the control module 104. A first terminal of a power transistor 126 is connected to a first output of the rectifier 120. A second terminal is connected to the control module 104 and to a first terminal of a power transistor 128. The control module 104 switches the power transistors on and off to vary current and/or voltage to the florescent light 10 during startup and/or operation.

A capacitor C1 may be connected to the first output of the rectifier 120, the second terminal of the power transistor 126, the first terminal of the power transistor 128 and one end of an inductor L. An opposite end of the inductor L may communicate with one end of the electrode 18A. An opposite end of the electrode 18A is coupled by a capacitor C3 to one end of the electrode 18B. The first output of the rectifier 120 is coupled by a capacitor C2 to an opposite end of the electrode 18B.

Figure 5:
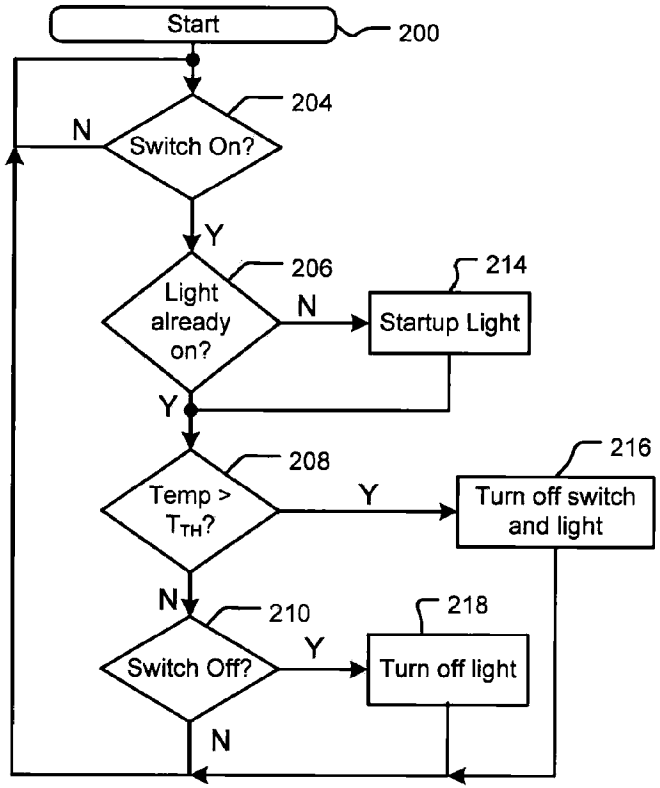
FIG. 5 is a first exemplary flowchart illustrating steps for operating the control system of FIG. 3.

Referring now to FIG. 5, a flowchart illustrating steps for operating the control system of FIG. 3 is shown. Control begins with step 200. In step 204, control determines whether the switch 24 is on. If false, control returns to step 204. If step 204 is true, control determines whether the florescent light 10 is already on. If true, control continues with step 208 and determines whether a sensed temperature is greater than a threshold temperature. The sensed temperature may relate to the electrolytic capacitor 56 and/or other components of the ballast module 100 and/or other components of the control system. If step 206 is false, control starts the light in step 214 continues with step 208. If step 208 is false and the threshold temperature has not been exceeded, control determines whether the switch 24 is off in step 210. If the switch 24 is not off, control returns to step 204.

When step 208 is true, control turns off the switch 24 and/or florescent light 10 in step 216. In some implementations, the switch 24 may be controlled by the control module 104. Alternately, the control module 104 may turn off the florescent light 10 independent from a position of the switch 24. Alternately, the control module 104 may operate as a three way switch in conjunction with a three-way switch 24. When step 210 is true and the switch 24 is off, control turns off the florescent light 10 in step 218.

Figure 6:
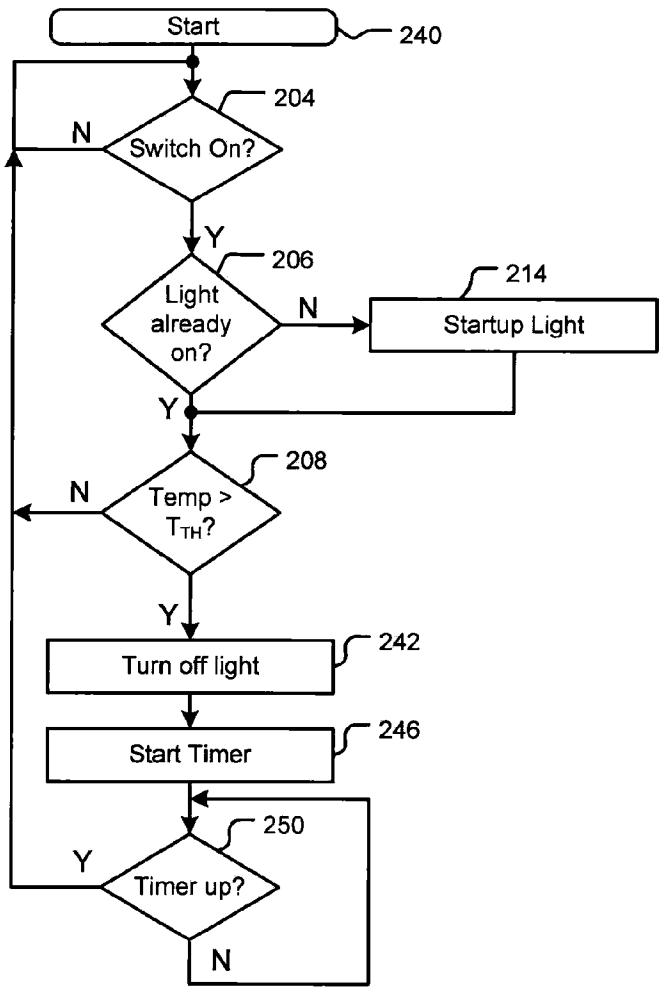
FIG. 6 is a second exemplary flowchart illustrating steps for operating the control system of FIG. 3.

Referring now to FIG. 6, a flowchart illustrating alternate steps for operating the control system of FIG. 3 is shown. When step 208 is false, control returns to step 204. When step 208 is true, control turns off the florescent light 10 in step 242. In step 246, control starts a timer. In step 250, control determines whether the timer is up. If step 250 is true, control returns to step 204. Otherwise, control returns to step 250.

Figure 7:
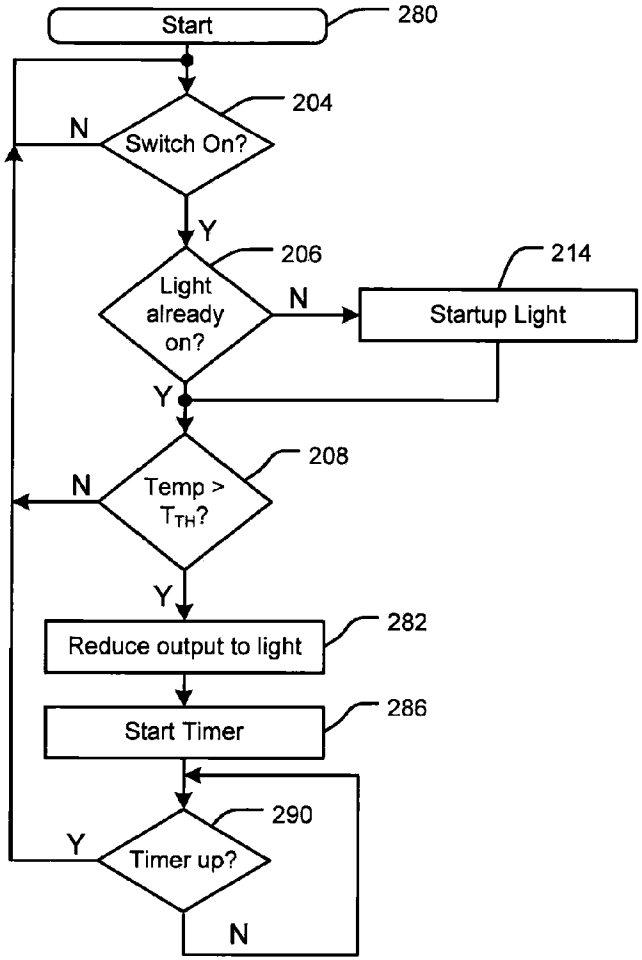
FIG. 7 is a third exemplary flowchart illustrating steps for operating the control system of FIG. 3.

Referring now to FIG. 7, a flowchart illustrating alternative steps for operating the control system of FIG. 3 is shown. When step 208 is true, control reduces power that is output to the florescent light 10 in step 282. Reducing power output to the florescent light 10 may include reducing voltage and/or current output by the ballast module 100. The florescent light 10 may be operated in this mode until reset using the switch 24. Alternately in step 286, control starts a timer. In step 290, control determines whether the timer is up. If step 290 is true, control returns to step 204. Otherwise, control returns to step 290.

Those skilled in the art can now appreciate from the foregoing description that the broad teachings of the present invention can be implemented in a variety of forms. For example, the temperature of a component can be sensed and the power output can be modulated accordingly. Hysteresis, averaging and/or other techniques can be used to reduce flicker and/or other noticeable changes in light intensity that may occur. Therefore, while this invention has been described in connection with particular examples thereof, the true scope of the invention should not be so limited since other modifications will become apparent to the skilled practitioner upon a study of the drawings, the specification and the following claims.

What is claimed is:

1. A circuit comprising:

a component connected (i) to a rectifier, and (ii) between a plurality of electrodes of a lamp, wherein the plurality of electrodes comprises a first electrode and a second electrode; and a control module in communication with the rectifier and configured to receive a temperature signal from a temperature sensor, wherein the temperature signal is indicative of a temperature of the component, while the lamp is ON, decrease current to the plurality of electrodes for a predetermined period and in response to the temperature of the component being greater than a predetermined temperature, and increase the current to the plurality of electrodes in response to the predetermined period expiring and independent of the temperature of the component.

2. The circuit of claim 1, further comprising the rectifier, wherein:

the rectifier is configured to receive power from an alternating current source; and the control module is configured to adjust the current to the plurality of electrodes based on (i) a power output of the rectifier, and (ii) the temperature of the component.

3. The circuit of claim 1, wherein the control module is configured to increase the current to the plurality of electrodes in response to the temperature of the component being less than the predetermined temperature.

4. The circuit of claim 1, wherein the control module is configured to increase the current to the plurality of electrodes (i) in response to the temperature of the component being greater than the predetermined temperature, and (ii) subsequent to the predetermined period expiring.

5. The circuit of claim 1, wherein the control module is configured to, in response to the temperature of the component being greater than the predetermined temperature, decrease the current to the plurality of electrodes subsequent to the increasing of the current to the plurality of electrodes.

6. The circuit of claim 1, wherein the control module is configured to:

switch on the lamp;

switch off the lamp in response to the temperature of the component being greater than the predetermined temperature;

start a timer in response to the lamp being switched off, wherein the timer indicates whether the predetermined period has expired; and switch the lamp on according to the timer and in response to the predetermined period expiring.

7. The circuit of claim 1, further comprising the rectifier, wherein:

the rectifier comprises a first input and a first output;

the control module comprises a second input and a second output; and terminals of the component are connected (i) between the first input and the first output, and (ii) between the second input and the second output.

8. The circuit of claim 1, further comprising transistors connected between the first electrode and the second electrode, wherein the control module controls operating states of the transistors to adjust the current to the first electrode and the second electrode.

9. The circuit of claim 1, further comprising:

a first capacitance connected between the control module and the first electrode;

a second capacitance connected between the control module and the second electrode; and a third capacitance connected between the first electrode and the second electrode.

10. The circuit of claim 9, wherein the first electrode, the second electrode, the first capacitance, the second capacitance, and the third capacitance are connected in series.

11. The circuit of claim 1, wherein the component comprises an electrolytic capacitance.

12. A circuit comprising:

a component connected (i) to a rectifier, and (ii) between a plurality of electrodes of a lamp, wherein the plurality of electrodes comprises a first electrode and a second electrode;

transistors connected between the first electrode and the second electrode; and a control module in communication with the rectifier and configured to receive a temperature signal from a temperature sensor, wherein the temperature signal is indicative of a temperature of the component, decrease current to the plurality of electrodes for a predetermined period when the temperature of the component is greater than a predetermined temperature, increase the current to the plurality of electrodes when the predetermined period expires and independent of the temperature of the component, and control operating states of the transistors to adjust the current to the first electrode and the second electrode, wherein the control module comprises, an input, a first output, a second output and a third output, and wherein the transistors comprise a first transistor having a first terminal, a second terminal, and a control terminal, wherein the first terminal is connected to the input of the control module, and wherein the control terminal is connected to the first output of the control module; and a second transistor having a first terminal, a second terminal, and a control terminal, wherein the first terminal of the second transistor is connected to the second terminal of the first transistor, wherein the second terminal of the second transistor is connected to the third output of the control module, and wherein the control terminal is connected to the second output of the control module.

13. The circuit of claim 12, wherein:

the first terminal of the first transistor is connected to an output of the rectifier; and the second terminal of the second transistor is connected to an input of the rectifier.

14. The circuit of claim 12, further comprising a capacitance having a first terminal and a second terminal, wherein:

the first terminal of the capacitance is connected to the first terminal of the first transistor;

the second terminal of the capacitance is connected to the second terminal of the first transistor; and the capacitance is connected (i) between the first electrode and the second electrode, and (ii) between the input of the control module and the first electrode.

15. The circuit of claim 12, further comprising an inductance connected:

between the first electrode and the second terminal of the first transistor;

between the first electrode and the first terminal of the second transistor; and between the first electrode and a terminal of the control module.

16. The circuit of claim 12, further comprising:

a capacitance connected between the first electrode and the input of the control module; and an inductance connected between the first electrode and the capacitance.

17. A method comprising:

operating a control module based on an output of a rectifier;

receiving a temperature signal from a temperature sensor by the control module, wherein the temperature signal is indicative of a temperature of a component, wherein the component is connected (i) to the rectifier, and (ii) between a plurality of electrodes of a lamp, wherein the plurality of electrodes include a first electrode and a second electrode;

while the lamp is ON and via the control module, decreasing current to the plurality of electrodes for a predetermined period and in response to the temperature of the component being greater than a predetermined temperature; and via the control module, increasing the current to the plurality of electrodes in response to the predetermined period expiring and independent of the temperature of the component.

18. The method of claim 17, further comprising increasing the current to the plurality of electrodes in response to the temperature of the component being less than the predetermined temperature.

19. The method of claim 17, further comprising:

increasing the current to the plurality of electrodes (i) in response to the temperature of the component being greater than the predetermined temperature, and (ii) subsequent to the predetermined period expiring; and subsequent to the increasing of the current, decreasing the current to the plurality of electrodes in response to the temperature of the component being greater than the predetermined temperature.

20. The method of claim 17, further comprising:

switching on the lamp;

switching off the lamp in response to the temperature of the component being greater than the predetermined temperature;

starting a timer in response to the lamp being switched off, wherein the timer indicates whether the predetermined period has expired; and switching the lamp on according to the timer and in response to the predetermined period expiring.

* * * * *